US008931832B2

(12) United States Patent
Lau

(10) Patent No.: US 8,931,832 B2
(45) Date of Patent: Jan. 13, 2015

(54) SWIVEL STOOL

(76) Inventor: Fermi Chi Hung Lau, Kowloon (HK)

( * ) Notice: Subject to any disclaimer, the term of this patent is extended or adjusted under 35 U.S.C. 154(b) by 238 days.

(21) Appl. No.: 13/506,935

(22) Filed: May 25, 2012

(65) Prior Publication Data

US 2013/0313864 A1 Nov. 28, 2013

(51) Int. Cl.
*A47C 4/00* (2006.01)

(52) U.S. Cl.
USPC ..... 297/44; 297/51; 297/53; 297/56; 297/188.08; 297/188.21

(58) Field of Classification Search
CPC ..... A47C 3/18; A47C 4/14; A47C 4/24; A47C 4/38; A47C 4/48
USPC ..... 297/34, 42, 44, 51, 53, 56, 188.08, 297/188.1, 188.21, 188.01, 16.2
See application file for complete search history.

(56) References Cited

U.S. PATENT DOCUMENTS

| | | | | | |
|---|---|---|---|---|---|
| 816,853 | A * | 4/1906 | Eisele | 297/53 |
| 1,001,193 | A * | 8/1911 | Fryman | 297/53 |
| 1,434,777 | A * | 11/1922 | Handler | 297/19 |
| 2,360,231 | A * | 10/1944 | Horton | 297/461 |
| 2,574,387 | A * | 11/1951 | Guthmann | 297/56 |
| 2,824,600 | A * | 2/1958 | Baumgardner | 297/34 |
| 2,982,455 | A * | 5/1961 | Rosen | 224/155 |
| 3,122,397 | A * | 2/1964 | Mintz | 297/188.13 |
| 3,797,695 | A * | 3/1974 | Law | 297/188.1 |
| 5,415,609 | A * | 5/1995 | Yang | 482/147 |
| 5,722,717 | A * | 3/1998 | Rettenberger | 297/188.1 |
| 5,730,489 | A * | 3/1998 | Eberle et al. | 297/53 |
| 5,848,822 | A * | 12/1998 | Wu | 297/344.18 |
| 6,000,752 | A * | 12/1999 | Shyr | 297/188.08 |
| 6,375,258 | B1 * | 4/2002 | Fang | 297/188.08 |
| 6,890,033 | B1 * | 5/2005 | Casella | 297/344.21 |
| 7,114,773 | B2 * | 10/2006 | Ho | 297/188.08 |
| 7,350,856 | B1 * | 4/2008 | Tseng | 297/45 |
| 7,753,441 | B1 * | 7/2010 | Gray, Jr. | 297/188.11 |
| 8,231,171 | B2 * | 7/2012 | Leng | 297/56 |
| 2004/0227381 | A1 * | 11/2004 | Redzisz et al. | 297/42 |
| 2008/0012399 | A1 * | 1/2008 | Lin | 297/188.08 |
| 2009/0243345 | A1 * | 10/2009 | Carter et al. | 297/16.2 |
| 2009/0243346 | A1 * | 10/2009 | Chen | 297/51 |

FOREIGN PATENT DOCUMENTS

| | | | | |
|---|---|---|---|---|
| EP | 291433 | A1 * | 11/1988 | A47C 4/14 |

* cited by examiner

*Primary Examiner* — Laurie Cranmer
(74) *Attorney, Agent, or Firm* — Raymond Y. Chan; David and Raymond Patent Firm

(57) ABSTRACT

A swivel stool includes a foldable leg arrangement having a plurality of leg frames pivotally connected to each other to form a receiving cavity defined within the leg frames, a seat unit including a seat frame and a back frame pivotally connected to the seat frame. The swivel stool is arranged to operate between a folded position and an unfolded position, wherein in the folded position, the back frame is overlappedly folded toward the seat frame, while the seat unit is pivotally and downwardly folded with respect to the leg frames to receive into the receiving cavity of the foldable leg arrangement, wherein in the unfolded position, the seat unit is pivotally and upwardly unfolded with respect to the leg frames while the back frame is pivotally unfolded with respect to the seat frame for allowing a user to sit on the seat unit.

26 Claims, 6 Drawing Sheets

SWIVEL STOOL

BACKGROUND OF THE PRESENT INVENTION

1. Field of the Invention

The present invention relates to a stool, and more particularly to a swivel stool comprising a foldable leg arrangement and a seat unit which is capable of selectively folded and received in the foldable leg arrangement for substantially reducing an overall size of the swivel stool.

2. Description of Related Arts

A conventional foldable chair usually comprises a leg frame and a support frame provided on the leg frame for allowing a person to sit thereon. Very often, the leg frame comprises a plurality of leg members pivotally and foldably connected to each other to form an X-shaped cross section. The support frame usually comprises a back frame and a seat frame pivotally mounted on the seat frame so that it is capable of pivotally folding toward the back frame.

Conventionally, the foldable chair is typically capable of working between a folded position and an unfolded position, wherein in the folded position, the leg members are pivotally folded toward each other while the seat frame is also pivotally folded toward the back frame so as to reduce the foldable chair into a relatively compact size. When the foldable chair is in the unfolded position, the leg members are pivotally unfolded to form an X-shaped cross section, while the seat frame is pivotally unfolded away from the back frame and supported on the leg frame so as to allow a person to safely sit on the support frame.

There are several disadvantages related to the above-mentioned foldable chair. First, the foldable chair is only foldable in the sense that the leg members are foldable toward each other. This means that the support frame cannot be folded with respect to the leg frame. When the foldable chair is folded in this conventional manner, the seat frame and the back frame still occupies a considerable amount of space even if the foldable chair is folded.

Second, in order to design a sufficiently secure structure for the foldable chair, each of the leg members are usually inclinedly extended from the support frame and each of the leg frames further comprises a reinforcing member transversely extended between the leg members of the corresponding leg frame so as to reinforce a supporting strength of that leg frame. Due to presence of this reinforcing member, the space underneath the support frame is not capable of storing object. As a result, the extent to which the foldable chair can be folded is severely limited by the presence of structural members underneath the support frame.

One may think that removing the reinforcing member from the leg frame may allow more space underneath the support frame. This may also extent to which the foldable chair can be folded. However, removing the reinforcing member severely decreases the strength and stability of the foldable chair and when a heavy person is sitting on the foldable chair, the structure thereof may be unable to support such a large loading and this may impart dangers to that person.

Third, the support frame of the conventional foldable chair is usually provided above the leg frame without any room for movement. In other words, because of the need to retain the strength and stability of the foldable chair as a whole, it is difficult for the manufacturer to make the support frame movable while retaining a supporting strength thereof.

SUMMARY OF THE PRESENT INVENTION

The invention is advantageous in that it provides a swivel stool comprising a foldable leg arrangement and a seat unit which is capable of selectively folded and received in the foldable leg arrangement for substantially reducing an overall size of the swivel stool.

Another advantage of the invention is to provide a swivel stool comprising a foldable leg arrangement and a seat unit, which is capable of rotating or swiveling with respect to the foldable leg arrangement.

Another advantage of the invention is to provide a swivel stool comprising a foldable leg arrangement and a seat unit, which is capable of folding into the foldable leg arrangement for forming the compact size of the swivel stool.

Another advantage of the invention is to provide a swivel stool comprising a foldable leg arrangement and a seat unit, which is arranged to form a receiving cavity when the swivel stool is at the unfolded position. As a result, a user is able to store an object, such as his or her personal belonging, into the receiving cavity.

Another advantage of the invention is to provide a swivel stool comprising a foldable leg arrangement and a seat unit which do not involve complicated mechanical components and structure. As a result, the manufacturing cost and the ultimate selling price of the present invention can be minimized.

Additional advantages and features of the invention will become apparent from the description which follows, and may be realized by means of the instrumentalities and combinations particular point out in the appended claims.

According to the present invention, the foregoing and other objects and advantages are attained by providing a swivel stool, comprising:

a foldable leg arrangement, which comprises a plurality of leg frames pivotally connected to each other to form a receiving cavity defined within the leg frames; and a seat unit, which comprises a seat frame attached on the foldable leg arrangement in a foldably movable manner; and a back frame pivotally connected to the seat frame, wherein the swivel stool is arranged to operate between a folded position and an unfolded position, wherein in the folded position, the back frame is overlappedly folded toward the seat frame, while the seat unit is pivotally and downwardly folded with respect to the leg frames to receive into the receiving cavity of the foldable leg arrangement so as to reduce the swivel stool into a compact size, wherein in the unfolded position, the seat unit is pivotally and upwardly unfolded with respect to the leg frames while the back frame is pivotally unfolded with respect to the seat frame for allowing a user to sit on the seat unit, wherein the receiving cavity is cleared for receiving an object therein.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
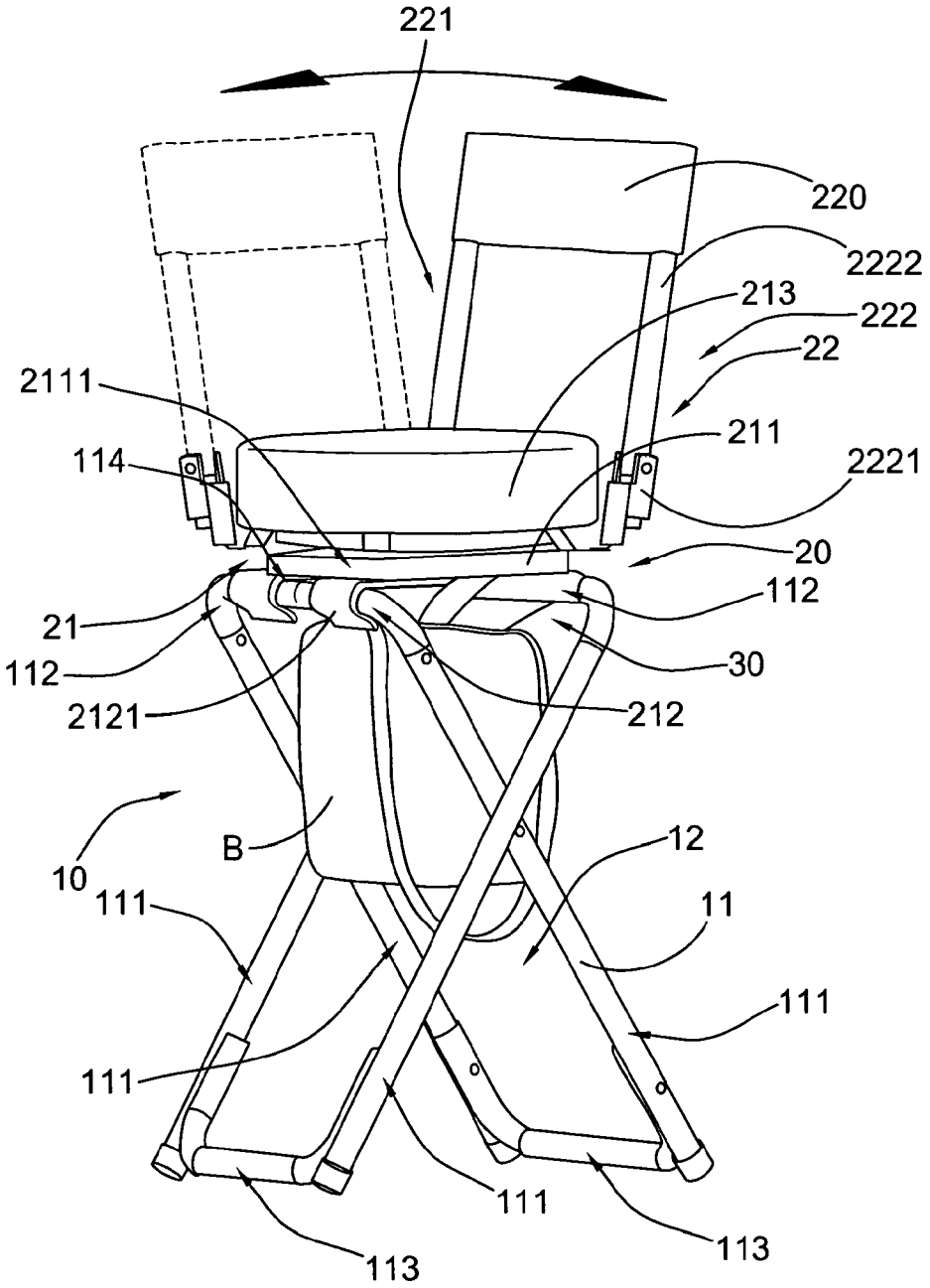
FIG. 1 is a perspective view of a swivel stool according to a preferred embodiment of the present invention.
Figure 2:
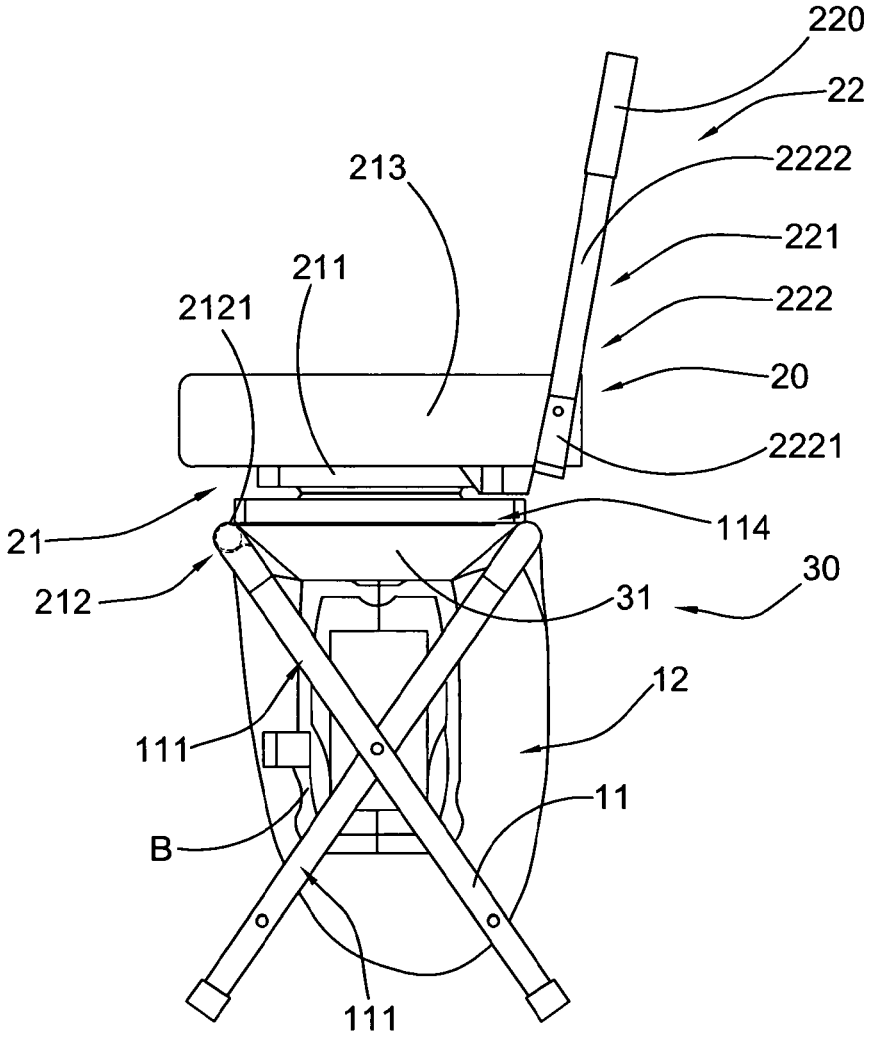
FIG. 2 is a side view of the swivel stool according to the above preferred embodiment of the present invention.
Figure 3:
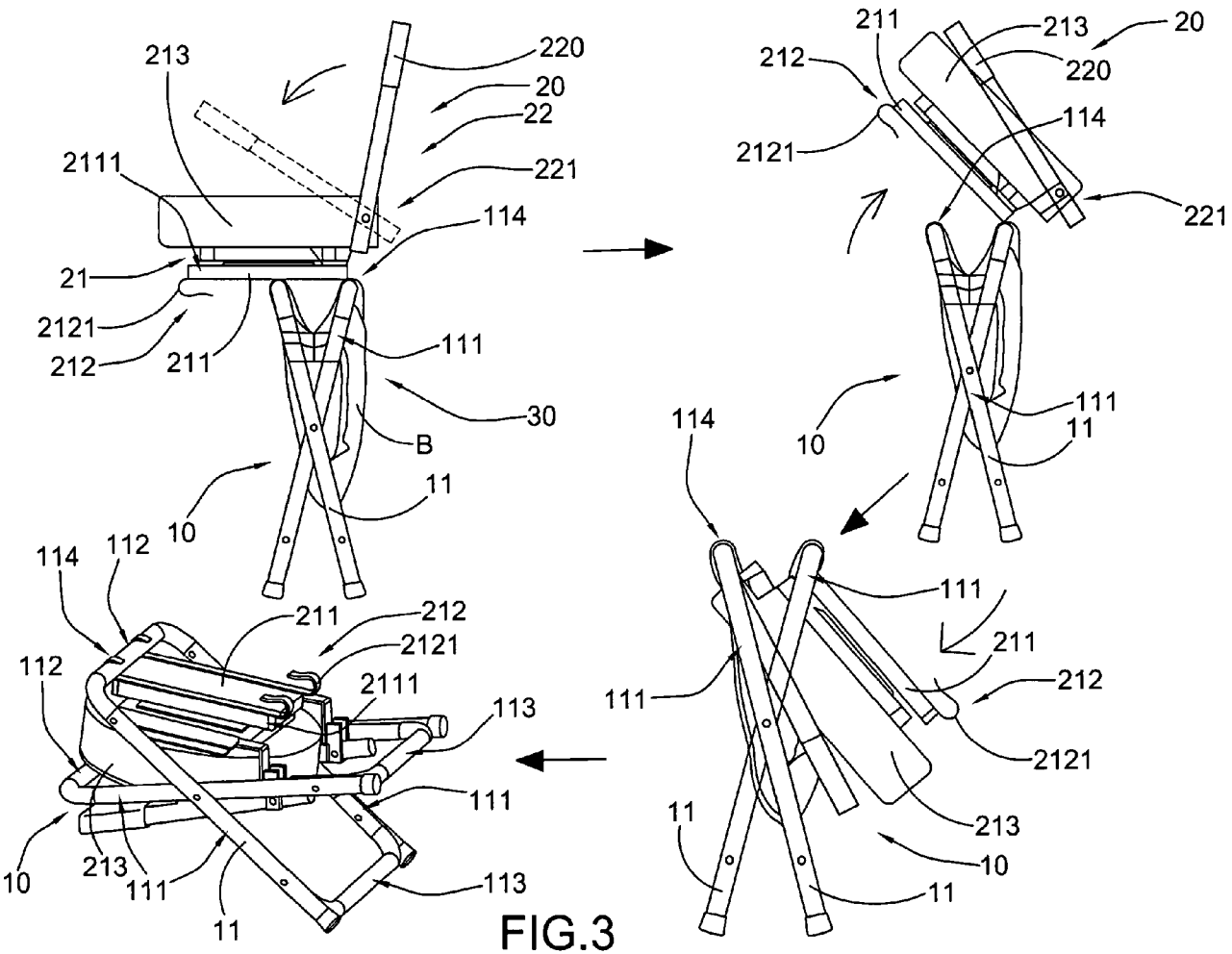
FIG. 3 is a schematic diagram of a folding mechanism of the swivel stool according to the above preferred embodiment of the present invention.

Referring to FIG. 1, to FIG. 3 of the drawings, a swivel stool according to a preferred embodiment of the present invention is illustrated, in which the swivel stool comprises a foldable leg arrangement 10, and a seat unit 20.

The foldable leg arrangement 10 comprises a plurality of leg frames 11 pivotally connected to each other to form a receiving cavity 12 defined within the leg frames 11.

The seat unit 20 comprises a seat frame 21 attached on the foldable leg arrangement 10 in a foldably movable manner, and a back frame 22 pivotally connected to the seat frame 21, wherein the swivel stool is arranged to operate between a folded position and an unfolded position, wherein in the folded position, the back frame 22 is overlappedly folded toward the seat frame 21, while the seat unit 20 is pivotally and downwardly folded with respect to the leg frames 21 to receive into the receiving cavity 12 of the foldable leg arrangement 10 so as to reduce the swivel stool into a compact size, wherein in the unfolded position, the seat unit 20 is pivotally and upwardly unfolded with respect to the leg frames 21 while the back frame 22 is pivotally unfolded with respect to the seat frame 21 for allowing a user to sit on the seat unit 20, wherein the receiving cavity 12 is cleared for receiving an object therein, such as the personal belongings B of the user sitting on the swivel stool.

According to the preferred embodiment of the present invention, each of the leg frames 11 has two longitudinal portions 111, a upper transverse portion 112 extended from between two upper ends of the longitudinal portions 111, and a lower transverse portion 113 extended between two lower ends of the longitudinal portions 111 to form a substantially rectangular cross section of the corresponding leg frame 11, wherein the seat unit 20 is mounted above the upper transverse portions 112 of the leg frames 11.

Moreover, the upper transverse portions 112 of the leg frames 11 has a supporting platform for allowing a user to suspendedly hang or support personal belongings B in the receiving cavity 12.

On the other hand, the seat frame 21 of the seat unit 20 comprises a frame member 211 mounted on the supporting platform 114, and a retention member 212 provided at a front end portion 2111 of the frame member 211, wherein when the swivel stool is operated at the unfolded position, one of the upper transverse portions 112 of the corresponding leg frame 11 is arranged to engage with the retention member 212 so as to restrain a further pivotal movement of the corresponding leg frame 11 while the leg frames 11 are arranged to securely support the seat unit 20 and the person sitting thereon.

More specifically, the retention member 212 comprises a retention hook 2121 formed at the front end portion 2111 of the frame member 211 and is downwardly extended therefrom for selectively engaging with the corresponding upper transverse portion 112 of the leg frame 11. Thus, from some physics, it can be seen that the greater the loading on the seat frame 21, the more secure the engagement between the retention hook 2121 and the corresponding upper transverse portion 112 of the corresponding leg frame 11.

Furthermore, the seat frame 21 further comprises a seat cushion 213 rotatably mounted on the frame member 211 so that the seat cushion 213 is capable of freely rotating above the leg frames 11.

The back frame 22 comprises a back support frame 221 and a back cushion 220 mounted on the back support frame 221 for providing a cushion effect to the user sitting on the swivel stool. The back support frame 221 comprises a plurality of frame extension units 222 spacedly mounted at two side edge portions of the frame member 211, wherein each of the frame extension units 222 comprises a base unit 2221 pivotally mounted on the corresponding side edge portion of the frame member 211, and an adjustable unit 2222 upwardly extended from and adjustably coupled to the base unit 2221, wherein the back cushion 220 is mounted between the adjustable units 2222 for providing the cushion effect to the user. For each of the frame extension units 222, the adjustable unit 2222 is slidably and adjustable connected to the corresponding base unit 2221 so that the user is able to adjust a height of the back frame 22.

In order to facilitate the folding mechanism of the swivel stool, the each of the base units 2221 is pivotally connected to the corresponding side edge portion of the frame member 211 in such a manner that the base units 2221 are capable of pivotally and rearward folding into the receiving cavity 12 of the foldable leg arrangement 10. At the same time, the seat cushion 213 is pivotally mounted with respect to the base units 2221 so that the seat cushion 213 is capable of pivotally and overlappedly folding toward the back frame 22. Thus, seat cushion 213 which is overlappedly folded on the back frame 22 is then capable of following the base units 2221 to pivotally folded into the receiving cavity 12 when the swivel stool is at the folded position. In other words, the seat cushion 213 is pivotally mounted on the base units 2221 which are pivotally mounted on the frame member 211 in such a manner that both the seat cushion 213 and the back frame 22 are arranged to be folded and received in the receiving cavity 12 when the swivel stool is at the folded position. As such, the swivel stool of the present invention can be reduced to a very compact size for convenient and easy storage and transportation.

Furthermore, the swivel stool further comprises a support arrangement 30 mounted on the foldable leg arrangement 10 and is arranged to support an object in the receiving cavity 12 when the swivel stool is at the unfolded position.

The support arrangement 30 comprises a holding strap 31 mounted on the upper transverse portions 112 of the leg frames 11, wherein a user is able to tighten an object, such as a personal belonging B, on the holding strap 31 which is arranged to suspenedly support the object in the receiving cavity 12 when the swivel stool is at the unfolded position.

The operation of the present invention is as follows: a user is able to freely operate the swivel stool in the folded position or the unfolded position. When the swivel stool is in the unfolded position, a user is able to sit on the seat unit and fasten his personal belonging B in the receiving cavity 12 through the holding strap 31 of the support arrangement 30. When the swivel stool is not in use, the user may consider reduce it into the folded position. In order to do so, the user need to fold the seat cushion 213 toward the back frame 22, which is then pivotally and rearwardly folded into the receiving cavity 12. In other words, the back frame is pivotally folded at approximately 180° with respect to the foldable leg arrangement 10.

Figure 4:
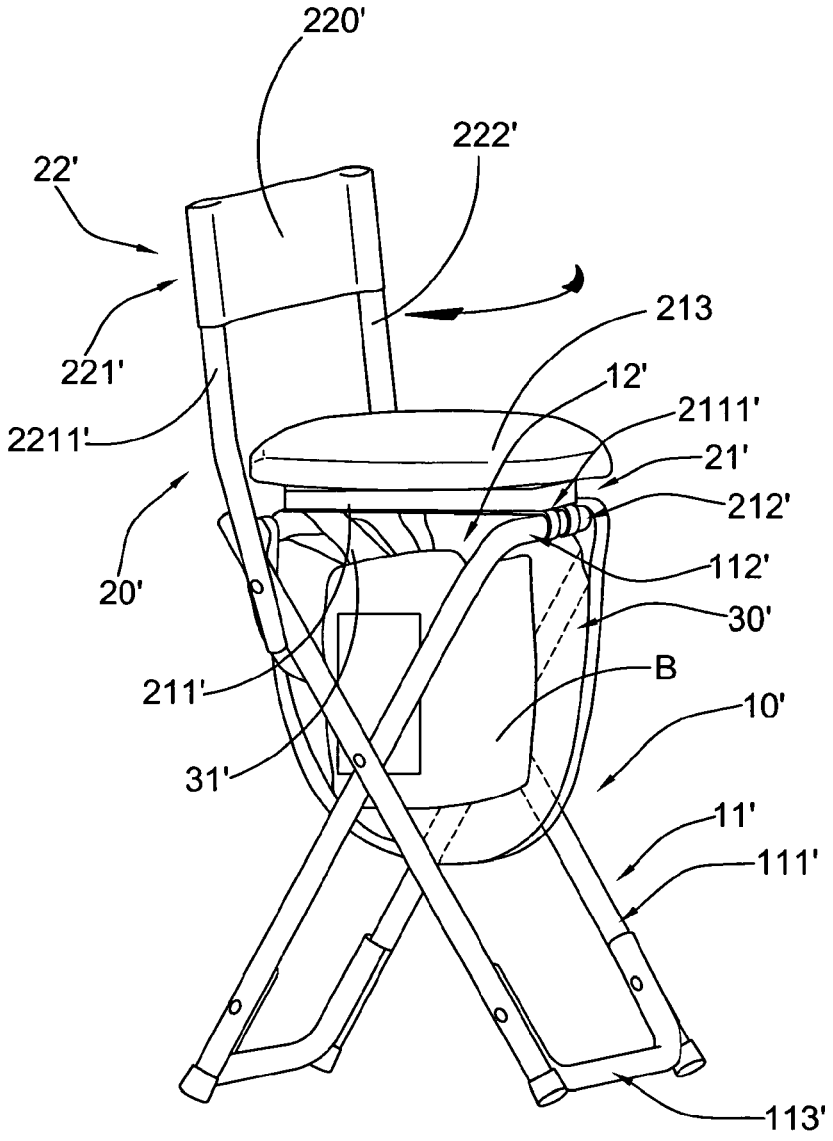
FIG. 4 is an alternative mode of the swivel stool according to a preferred embodiment of the present invention.
Figure 5:
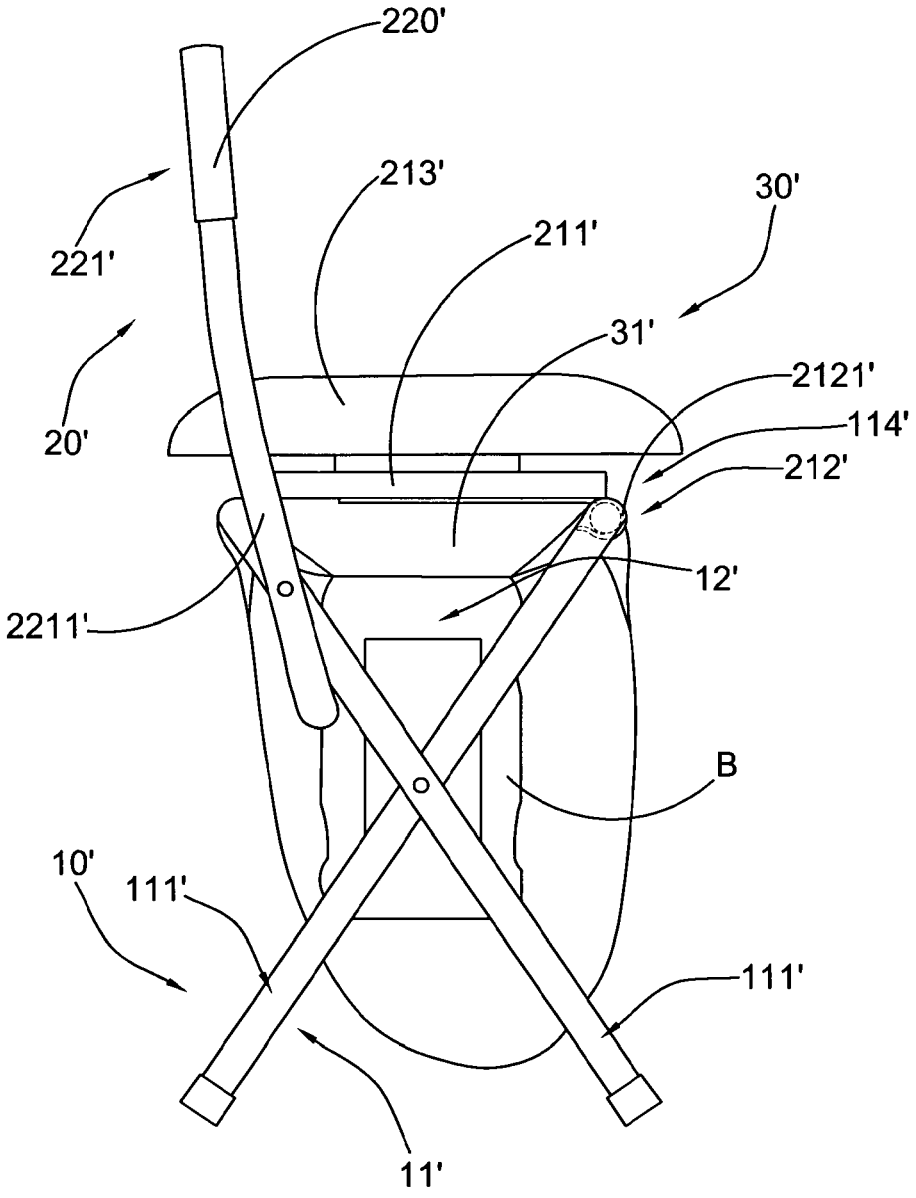
FIG. 5 is a side view of the swivel stool according to the above preferred embodiment of the present invention.
Figure 6:
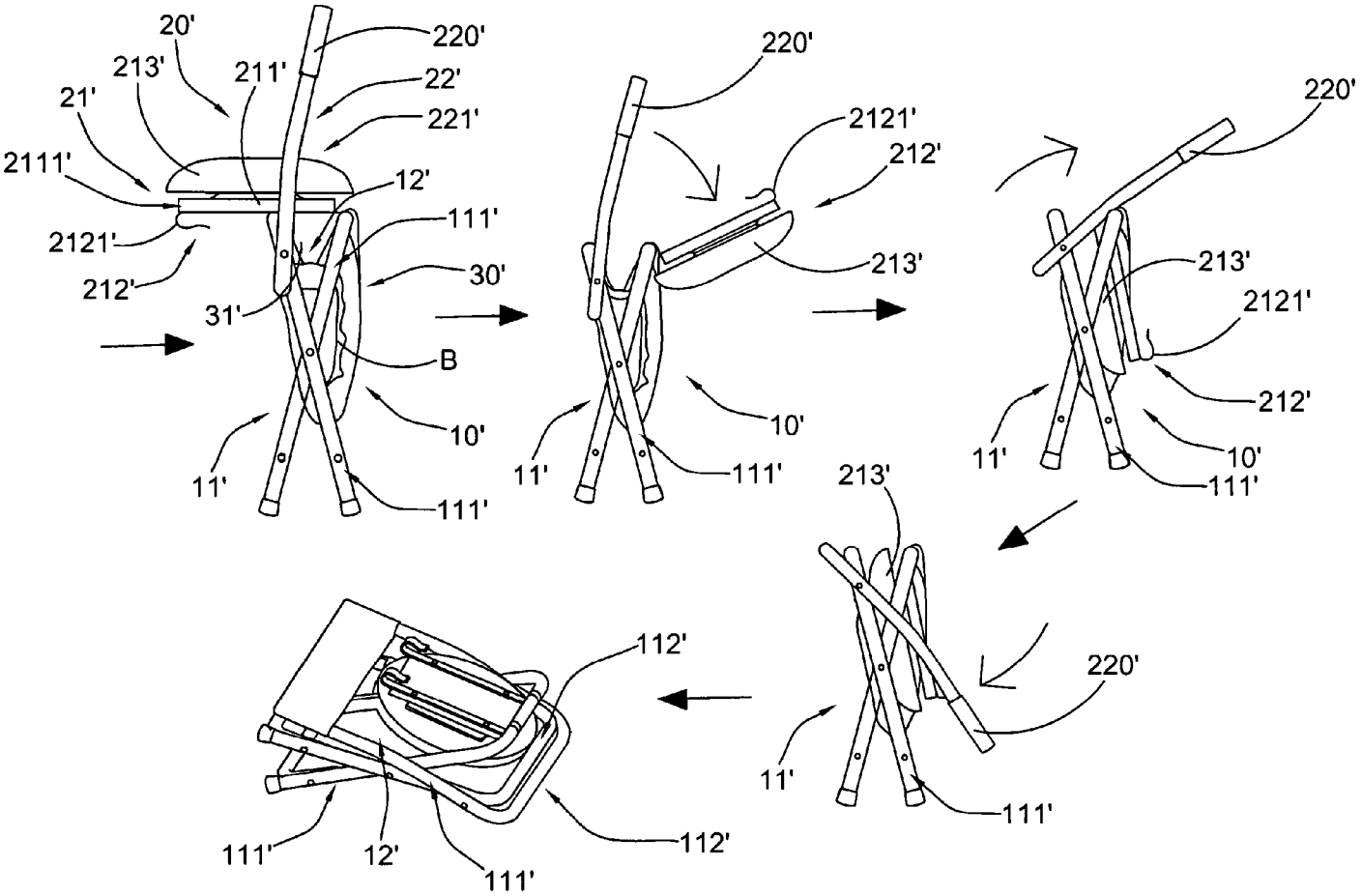
FIG. 6 is a schematic diagram of a folding mechanism of the swivel stool according to the above preferred embodiment of the present invention.

Referring to FIG. 4 to FIG. 6 of the drawings, an alternative mode of the swivel stool according to the preferred embodiment of the present invention is illustrated. The alternative mode is similar to the preferred embodiment, except the folding mechanism. More specifically, according to the alternative mode, the foldable leg arrangement 10' comprises a plurality of leg frames 11' pivotally connected to each other to form a receiving cavity 12' defined within the leg frames 11'.

The seat unit 20' comprises a seat frame 21' attached on the foldable leg arrangement 10' in a foldably movable manner, and a back frame 22' pivotally connected to the seat frame 21', wherein the swivel stool is arranged to operate between a folded position and an unfolded position as mentioned in the preferred embodiment above. However, the manner in which the swivel stool fold from the folded position to the unfolded position or vice versa is different from that disclosed in the preferred embodiment above.

Each of the leg frames 11' has two longitudinal portions 111', a upper transverse portion 112' extended from between two upper ends of the longitudinal portions 111', and a lower transverse portion 113' extended between two lower ends of the longitudinal portions 111' to form a substantially rectangular cross section of the corresponding leg frame 11', wherein the seat unit 20' is mounted above the upper transverse portions 112' of the leg frames 11'.

Moreover, each of the upper transverse portions 112' of the leg frames 11' has a supporting platform 114' for allowing a user to suspenedly hang or support personal belongings B in the receiving cavity 12'.

On the other hand, the seat frame 21' of the seat unit 20' comprises a frame member 211' mounted on the supporting platform 114', and a retention member 212' provided at a front end portion 2111' of the frame member 211', wherein when the swivel stool is operated at the unfolded position, one of the upper transverse portions 112' of the corresponding leg frame 11' is arranged to engage with the retention member 212' so as to restrain a further pivotal movement of the corresponding leg frame 11' while the leg frames 11' are arranged to securely support the seat unit 20' and the person sitting thereon. This is the same as that of the preferred embodiment.

Moreover, in this alternative mode, the seat frame 21' of the seat unit 20' is rotatably connected to the upper transverse portion 112' of one of the leg frames 11' so that the seat frame 21' is capable of rotating with respect to and about a transverse direction of the leg frames 11'.

More specifically, the retention member 212' comprises a retention hook 2121' formed at the front end portion 2111' of the frame member 211' and is downwardly extended therefrom for selectively engaging with the corresponding upper transverse portion 112' of the leg frame 11'.

Furthermore, the seat frame 21' further comprises a seat cushion 213' rotatably mounted to the frame member 211' with respect to the leg frames 11' so that the seat cushion 213' is capable of freely rotating above the leg frames 11'.

The back frame 22' comprises a back support frame 221' and a back cushion 220' mounted on the back support frame 221' for providing a cushion effect to the user sitting on the swivel stool. In this alternative mode, the back frame 22' is pivotally and directly connected to the leg frames 11' so that the back frame 221' is capable of rearwardly folding with respect to the leg frames 11'.

More specifically, the back support frame 221' comprises a plurality of frame extension units 2211' spacedly mounted at two side edge portions of the corresponding leg frames 11' respectively, wherein each of the frame extension units 2211' is pivotally mounted on the corresponding transverse portion 112' of the leg frame 11', wherein the back cushion 220' is mounted between the frame extension units 2211' for providing the cushion effect to the user.

In order to facilitate the folding mechanism of the swivel stool, each of the frame extension units 2211' is pivotally connected to the corresponding side edge portion of the corresponding leg frame 11' in such a manner that the fame extension units 2211' are capable of pivotally and rearwardly folding into the receiving cavity 12' of the foldable leg arrangement 10'. At the same time, the seat cushion 213 is also connected to the seat frame 21' so that the seat cushion 213' along with the seat frame 21' are capable of pivotally and overlappedly folding toward the back frame 22'.

Thus, seat cushion 213' which is folded toward the back frame 22' is then capable of being pivotally fold into the receiving cavity 12' when the swivel stool is at the folded position. In other words, the seat cushion 213' is mounted on the seat frame 21' in such a manner that both the seat cushion 213' and the seat frame 21' are arranged to be folded and received in the receiving cavity 12' when the swivel stool is at the folded position. As such, the swivel stool of the present invention can be reduced to a very compact size for convenient and easy storage and transportation.

Furthermore, the swivel stool further comprises a support arrangement 30' mounted on the foldable leg arrangement 10' and is arranged to support an object in the receiving cavity 12' when the swivel stool is at the unfolded position.

As shown in FIG. 4 to FIG. 5 of the drawings, the support arrangement 30' comprises a holding strap 31' mounted on the upper transverse portions 112' of the leg frames 11', wherein a user is able to tighten an object, such as a personal belonging B, on the holding strap 31' which is arranged to suspenedly support the object in the receiving cavity 12' when the swivel stool is at the unfolded position.

As described in the preferred embodiment mentioned above, a user is able to freely operate the swivel stool in the folded position or the unfolded position. When the swivel stool is in the unfolded position, a user is able to sit on the seat unit and fasten his personal belonging B in the receiving cavity 12' through the holding strap 31' of the support arrangement 30'. When the swivel stool is not in use, the user may consider reduce it into the folded position. In order to do so, the user need to fold the seat cushion 213' toward the back frame 22', which is then pivotally and rearwardly folded into the receiving cavity 12'. In other words, the back frame is pivotally folded at approximately 180° with respect to the foldable leg arrangement 10'.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A swivel stool, comprising:

a foldable leg arrangement, which comprises a plurality of leg frames pivotally connected to each other to form a receiving cavity defined within said leg frames; and a seat unit, which comprises:

a seat frame attached on said foldable lea arrangement in a foldably movable manner; and a back frame pivotally extended from said seat frame, wherein said swivel stool is arranged to operate between a folded position and an unfolded position, wherein in said folded position, said back frame is overlappedly folded toward said seat frame, while said seat unit is pivotally and downwardly folded with respect to said leg frames to receive into said receiving cavity of said foldable leg arrangement so as to reduce said swivel stool into a compact size, wherein in said unfolded position, said seat unit is pivotally and upwardly unfolded with respect to said leg frames while said back frame is pivotally unfolded with respect to said seat frame for allowing a user to sit on said seat unit, wherein said receiving cavity is cleared for receiving an object therein, wherein said back frame is pivotally connected to said seat frame for folding between said folded position and said unfolded position, wherein each of said leg frames has two longitudinal portions, an upper transverse portion extended from between two upper ends of said longitudinal portions, and a lower transverse portion extended between two lower ends of said longitudinal portions to form a substantially rectangular cross section of said corresponding leg frame, wherein said seat unit is mounted above said upper transverse portions of said leg frames, wherein each of said upper transverse portions of said leg frames has a supporting platform for suspendedly hanging or supporting said object in said receiving cavity, wherein said seat frame of said seat unit comprises a frame member rotatably mounted on said supporting platform, and a retention member provided at a front end portion of said frame member, wherein when said swivel stool is operated at said unfolded position, one of said upper transverse portions of said corresponding leg frame is arranged to engage with said retention member so as to restrain a further pivotal movement of said corresponding leg frame while said leg frames are arranged to securely support said seat unit and said person sitting thereon.

2. The swivel stool, as recited in claim 1, wherein said retention member comprises a retention hook formed at said front end portion of said frame member and is to downwardly extended therefrom for selectively engaging with said corresponding upper transverse portion of said leg frame.

3. The swivel stool, as recited in claim 2, wherein said seat frame further comprises a seat cushion mounted on said frame member so that said seat cushion is capable of freely rotating above said leg frames.

4. The swivel stool, as recited in claim 3, wherein said back frame comprises a back support frame and a back cushion mounted on said back support frame for providing a cushion effect to said user sitting on said swivel stool.

5. The swivel stool, as recited in claim 4, wherein said back support frame comprises a plurality of frame extension units spacedly mounted at two side edge portions of said frame member, wherein each of said frame extension units comprises a base unit mounted on said corresponding side edge portion of said frame member, and an adjustable unit upwardly and pivotally extended from and adjustably coupled to said base unit, wherein said back cushion is mounted between said adjustable units for providing said cushion effect to said user.

6. The swivel stool, as recited in claim 5, wherein each of said base units is connected to said corresponding side edge portion of said frame member in such a manner that said adjustable unit is capable of pivotally and rearward folding into said receiving cavity of said foldable leg arrangement.

7. The swivel stool, as recited in claim 6, wherein said seat cushion is mounted to said base units so that said seat cushion is capable of pivotally and overlappedly folding toward said back frame via said adjustable unit, such that said seat cushion which is overlappedly folded on said back frame and is capable of following said adjustable unit to pivotally folded into said receiving cavity when said swivel stool is at said folded position.

8. The swivel stool, as recited in claim 7, wherein said swivel stool further comprises a support arrangement mounted on said foldable leg arrangement and is arranged to support said object in said receiving cavity when said swivel stool is at said unfolded position.

9. The swivel stool, as recited in claim 8, wherein said support arrangement comprises a holding strap mounted on said upper transverse portions of said leg frames for supporting said object on said holding strap which is arranged to suspenedly support said object in said receiving cavity when said swivel stool is at said unfolded position.

10. The swivel stool, as recited in claim 6, wherein said swivel stool further comprises a support arrangement mounted on said foldable leg arrangement and is arranged to support said object in said receiving cavity when said swivel stool is at said unfolded position.

11. The swivel stool, as recited in claim 10, wherein said support arrangement comprises a holding strap mounted on said upper transverse portions of said leg frames for supporting said object on said holding strap which is arranged to suspenedly support said object in said receiving cavity when said swivel stool is at said unfolded position.

12. The swivel stool, as recited in claim 2, wherein said swivel stool further comprises a support arrangement mounted on said foldable leg arrangement and is arranged to support said object in said receiving cavity when said swivel stool is at said unfolded position.

13. The swivel stool, as recited in claim 12, wherein said support arrangement comprises a holding strap mounted on said upper transverse portions of said leg frames for supporting said object on said holding strap which is arranged to suspenedly support said object in said receiving cavity when said swivel stool is at said unfolded position.

14. The swivel stool, as recited in claim 1, wherein said seat frame further comprises a seat cushion mounted on said frame member so that said seat cushion is capable of freely rotating above said leg frames.

15. The swivel stool, as recited in claim 14, wherein said back frame comprises a back support frame and a back cushion mounted on said back support frame for providing a cushion effect to said user sitting on said swivel stool.

16. The swivel stool, as recited in claim 15, wherein said back support frame comprises a plurality of frame extension units spacedly mounted at two side edge portions of said frame member, wherein each of said frame extension units comprises a base unit mounted on said corresponding side edge portion of said frame member, and an adjustable unit upwardly and pivotally extended from and adjustably coupled to said base unit, wherein said back cushion is mounted between said adjustable units for providing said cushion effect to said user.

17. The swivel stool, as recited in claim 16, wherein each of said base units is connected to said corresponding side edge portion of said frame member in such a manner that said adjustable unit is capable of pivotally and rearward folding into said receiving cavity of said foldable leg arrangement.

18. The swivel stool, as recited in claim 17, wherein said seat cushion is mounted to said base units so that said seat cushion is capable of pivotally and overlappedly folding toward said back frame via said adjustable unit, such that said seat cushion which is overlappedly folded on said back frame and is capable of following said adjustable unit to pivotally folded into said receiving cavity when said swivel stool is at said folded position.

19. A swivel stool, comprising:

a foldable leg arrangement, which comprises a plurality of leg frames pivotally connected to each other to form a receiving cavity defined within said leg frames; and a seat unit, which comprises:

a seat frame attached on said foldable leg arrangement in a foldably movable manner; and a back frame pivotally extended from said seat frame, wherein said swivel stool is arranged to operate between a folded position and an unfolded position, wherein in said folded position, said back frame is overlappedly folded toward said seat frame, while said seat unit is pivotally and downwardly folded with respect to said leg frames to receive into said receiving cavity of said foldable leg arrangement so as to reduce said swivel stool into a compact size, wherein in said unfolded position, said seat unit is pivotally and upwardly unfolded with respect to said leg frames while said back frame is pivotally unfolded with respect to said seat frame for allowing a user to sit on said seat unit, wherein said receiving cavity is cleared for receiving an object therein, wherein said back frame is pivotally connected to one of said corresponding leg frames for folding between said folded position and said unfolded position, wherein each of said leg frames has two longitudinal portions, an upper transverse portion extended from between two upper ends of said longitudinal portions, and a lower transverse portion extended between two lower ends of said longitudinal portions to form a substantially rectangular cross section of said corresponding leg frame, wherein said seat unit is mounted above said upper transverse portions of said leg frames, wherein each of said upper transverse portions of said leg frames has a supporting platform for suspenedly hanging or supporting said object in said receiving cavity, wherein said seat frame of said seat unit comprises a frame member mounted on said supporting platform, and a retention member provided at a front end portion of said frame member, wherein when said swivel stool is operated at said unfolded position, one of said upper transverse portions of said corresponding leg frame is arranged to engage with said retention member so as to restrain a further pivotal movement of said corresponding leg frame while said leg frames are arranged to securely support said seat unit and said person sitting thereon.

20. The swivel stool, as recited in claim 19, wherein said retention member comprises a retention hook formed at said front end portion of said frame member and is downwardly extended therefrom for selectively engaging with said corresponding upper transverse portion of said leg frame.

21. The swivel stool, as recited in claim 20, wherein said seat frame further comprises a seat cushion mounted on said frame member so that said seat cushion is capable of freely rotating above said leg frames.

22. The swivel stool, as recited in claim 21, wherein said back frame comprises a back support frame pivotally connected to said corresponding leg frame, and a back cushion mounted on said back support frame for providing a cushion effect to said user sitting on said swivel stool.

23. The swivel stool, as recited in claim 22, wherein said back support frame comprises a plurality of frame extension units spacedly mounted at two side edge portions of said leg frames respectively.

24. The swivel stool, as recited in claim 23, wherein said seat cushion is mounted to said base units so that said seat cushion is capable of pivotally and overlappedly folding toward said back frame via an adjustable unit, such that said seat cushion which is overlappedly folded on said back frame and is capable of following said adjustable unit to pivotally folded into said receiving cavity when said swivel stool is at said folded position.

25. The swivel stool, as recited in claim 24, wherein said swivel stool further comprises a support arrangement mounted on said foldable leg arrangement and is arranged to support said object in said receiving cavity when said swivel stool is at said unfolded position.

26. The swivel stool, as recited in claim 25, wherein said support arrangement comprises a holding strap mounted on said upper transverse portions of said leg frames for supporting said object on said holding strap which is arranged to suspenedly support said object in said receiving cavity when said swivel stool is at said unfolded position.

* * * * *